US008893928B2

(12) United States Patent
Proper

(10) Patent No.: US 8,893,928 B2
(45) Date of Patent: Nov. 25, 2014

(54) COUNTER MOUNTED DISPENSING SYSTEM WITH ABOVE-COUNTER REFILL UNIT

(75) Inventor: Scott T. Proper, Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 460 days.

(21) Appl. No.: 13/038,711

(22) Filed: Mar. 2, 2011

(65) Prior Publication Data

US 2011/0215115 A1 Sep. 8, 2011

Related U.S. Application Data

(60) Provisional application No. 61/309,476, filed on Mar. 2, 2010.

(51) Int. Cl.

| | |
|---|---|
| ***B65D 88/54*** | (2006.01) |
| ***A47K 5/00*** | (2006.01) |
| ***B67D 7/84*** | (2010.01) |
| ***B67D 7/76*** | (2010.01) |

(52) U.S. Cl.

CPC *B65D 88/54* (2013.01); *B67D 7/84* (2013.01); *B67D 7/76* (2013.01)

USPC ..... 222/173; 222/325; 222/333; 222/190

(58) Field of Classification Search

CPC ... A47K 2005/1218; A47K 5/12; A47K 5/16; A47K 5/12053; A47K 5/1205; A47K 5/1204

USPC ..... 222/52, 63, 180, 190, 173, 333, 325, 222/183, 135

See application file for complete search history.

(56) References Cited

U.S. PATENT DOCUMENTS

| | | | | |
|---|---|---|---|---|
| 1,229,556 | A | 6/1917 | Watrous | |
| 5,476,197 | A | 12/1995 | Lawrence et al. | |
| 5,632,414 | A * | 5/1997 | Merriweather, Jr. | 222/52 |
| 5,678,733 | A | 10/1997 | Ong | |
| 6,142,342 | A * | 11/2000 | Lewis | 222/180 |
| 6,467,651 | B1 * | 10/2002 | Muderlak et al. | 222/52 |
| 6,651,851 | B2 | 11/2003 | Muderlak et al. | |
| 6,910,604 | B2 | 6/2005 | Gugliotti et al. | |
| 7,025,227 | B2 * | 4/2006 | Oliver et al. | 222/61 |
| 7,198,175 | B2 * | 4/2007 | Ophardt | 222/188 |
| 7,364,053 | B2 * | 4/2008 | Ophardt | 222/190 |
| 2004/0226962 | A1 | 11/2004 | Mazursky et al. | |
| 2005/0155988 | A1 * | 7/2005 | Meehan et al. | 222/321.7 |
| 2007/0017932 | A1 * | 1/2007 | Ciavarella et al. | 222/153.09 |
| 2007/0084521 | A1 | 4/2007 | Rhodenbaugh et al. | |
| 2007/0289997 | A1 | 12/2007 | Lewis et al. | |
| 2009/0152293 | A1 * | 6/2009 | Sayers et al. | 222/52 |
| 2009/0188943 | A1 | 7/2009 | McCullough et al. | |

* cited by examiner

*Primary Examiner* — Paul R Durand
*Assistant Examiner* — Charles P Cheyney
(74) *Attorney, Agent, or Firm* — Renner Kenner Greive Bobak Taylor & Weber

(57) ABSTRACT

A counter-mounted dispensing system includes a refill housing mounted above a counter. A refill unit is selectively received in the refill housing in order to deliver a fluid within the refill unit to an end user. The refill unit includes a container holding fluid to be dispensed, and a pump communicating with the fluid in the container. A spout is also mounted above the counter and may be provided as part of the refill housing. An actuation unit having pump actuator mechanisms is mounted at a position below the counter. A passage extends through the counter, and the pump and the pump actuator mechanisms operatively communicate through the passage when the refill unit is installed in the refill housing.

10 Claims, 16 Drawing Sheets

COUNTER MOUNTED DISPENSING SYSTEM WITH ABOVE-COUNTER REFILL UNIT

PRIORITY STATEMENT

This application claims priority from U.S. provisional patent application Ser. No. 61/309,476 filed on Mar. 2, 2010, which is incorporated herein by reference in its entirety.

FIELD OF THE INVENTION

The present invention generally relates to liquid dispensers, and, more particularly, to counter mounted dispensers. More particularly, the present invention relates to counter mounted dispenser of the type employing a refill unit.

BACKGROUND OF THE INVENTION

There are generally four types of liquid dispensers that are mounted to or near a counter or simply rest on a counter, often near sink basins, to provide desired products such as soaps, sanitizers and lotions to individuals. These dispensers include wall-mounted dispensers and counter-mounted dispensers (two types) and unmounted portable pump dispensers.

Wall-mounted dispensers are generally known and are mounted to walls that are near to the counter. Wall-mounted dispensers are not of particular interest, but are disclosed to show that they can be replaced by dispensers of the type taught herein. Similarly, unmounted portable pump dispensers are generally known as portable containers of product that have associated pumps (typically reciprocating piston pumps) that are actuated to dispense product out of an outlet. Because these pumps are not mounted to any structure, they are typically not suitable for use at establishments serving the public, as they are susceptible to being stolen to the detriment of the owner of the establishment.

Of particular interest are counter mounted dispensers, of which there are currently two different types—those mounted fully above a counter and those having some elements mounted above the counter and other elements, including particularly the container of product to be dispensed, being mounted below the counter. An example of a fully above-counter dispenser is shown in FIG. 1 and designated by the numeral 10. The fully above-counter dispensers such as the dispenser 10 typically include a housing 14 that is either mounted to or simply resting on a counter C. A spout 18 extends from the housing and provides outlet 16 to dispense the product carried by the dispenser 10. The housing 14 carries all of the elements necessary to dispense product at the outlet 16, and, as generally appreciated in the art, those elements might include a product reservoir or container (to hold the product to be dispense), pump mechanisms, powering means (batteries or means for associating with mains power supply), hand free dispensing sensors or manual dispensing mechanisms and the like. Such dispensers 10 are securely mounted on the countertop or a ledge or other structure so as to make the product they dispense available to anyone that desires to actuate them. Currently it is believed that there are no such above-counter systems employing refill units, which are generally appreciated in the art to be self-contained units comprised of product containers (reservoirs) and pump mechanisms, the units being replaced when empty of product. Instead, these above-counter systems are known as bulk fill systems wherein the product to be dispensed is simply refilled directly into the appropriate receiving area in housing 14 when the housing 14 is empty of product. The wetted surfaces are thus not replaced and these dispensers must periodically be cleaned to maintain sanitation.

An example of a counter mounted dispenser having both elements mounted above and elements mounted below a counter is shown in cross-section in FIG. 2 and designated by the numeral 20. Counter-mounted dispensers 20 typically include a spout 28 that is provided above the counter C and a refill unit 30 that is received under the counter C in an under-counter housing 31. The refill unit 30 includes a pump (not shown) that communicates with the product S held inside of a container 24, and pump-actuating elements (not shown) and one or more dispensing tubes (not shown) extend through the passage P in the counter C. In these types of embodiments, the pump of the refill unit 30 is mechanically actuated by pressing on a plunger 25 to advance liquid from the container 24 and dispense it at the outlet 26 of a spout body 28.

These common design configurations for mounting dispensers at a counter have a number of drawbacks. The fully above counter dispensers occupy a large volume of space at the countertop, particularly in comparison to the volume of product that they carry. This is because these fully above counter dispensers must carry all the dispensing equipment (housings, product containers, pumps, actuator mechanisms, including actuating plungers or touchless sensor actuators, etc) above the counter and inside of the housing to provide an aesthetically acceptable unit. The actuation mechanisms take up a significant volume and thus leave less room for product containers, such that the product containers are significantly smaller than the dispenser housings. Additionally, those fully above counter units are bulk systems which have been shown to promote bacteria growth. The under counter refill type, as shown in FIG. 2 is a sanitary sealed system in which all wetted components are replaced with each refill change.

While those dispensers wherein the refill unit is carried under the counter do not suffer from the same problems as the fully above counter dispensers, servicing the refill unit under the counter presents its own challenges. A typical refill unit weighs between 3 and 6 pounds, and must be inserted into mounting mechanisms provided at the underside of the counter. It is difficult for service personnel to balance and insert the refill unit while hunched over the counter or squatting low to access space under the counter. Additionally, the water supply lines and drain piping under the counter often interfere with the removal of an empty refill unit and its replacement with a full refill unit. Finally, it is burdensome to check the level of liquid within the container of the refill unit, because it is located under the countertop such that one must crouch under the counter to view the container and the volume level of the product therein.

In light of the foregoing, the counter-mounted dispenser system arts would benefit from a dispensing system designed to reduce the volume of space required above the counter to mount the dispensing system, while still providing a sanitary sealed above counter refill unit. There is also a need in the art to provide a counter mounted dispenser system wherein one does not have to access the space underneath the counter to refill the system with product, as in prior art dispensing systems.

SUMMARY OF THE INVENTION

In one embodiment, this invention provides a counter-mounted dispensing system including a refill housing mounted above a counter. A refill unit is selectively received in the refill housing in order to deliver a fluid within the refill unit to an end user. The refill unit includes a container holding fluid to be dispensed, and a pump communicating with the fluid in the container. A spout is also mounted above the counter and may be provided as part of the refill housing. An actuation unit having pump actuator mechanisms is mounted at a position below the counter. A passage extends through the counter, and the pump and the pump actuator mechanisms operatively communicate through the passage when the refill unit is installed in the refill housing. By operative communicate it is meant that the pump and pump actuator mechanisms communicate such that the pump actuator mechanisms can act upon the pump to actuate it.

In other embodiments, the spout of the counter-mounted dispensing system as above provides a fluid outlet, and the communication between the pump and the pump actuator mechanisms is such that the pump actuator mechanisms can be operated to cause the pump to dispense fluid at the outlet of the spout. In further embodiments, a power source is associated with the pump actuator mechanism to provide power to actuate the actuator mechanisms and cause the pump to dispense fluid. In particular embodiments the power source for the pump actuator mechanisms is also located under the counter

DETAILED DESCRIPTION OF ILLUSTRATIVE EMBODIMENTS

Figure 1:
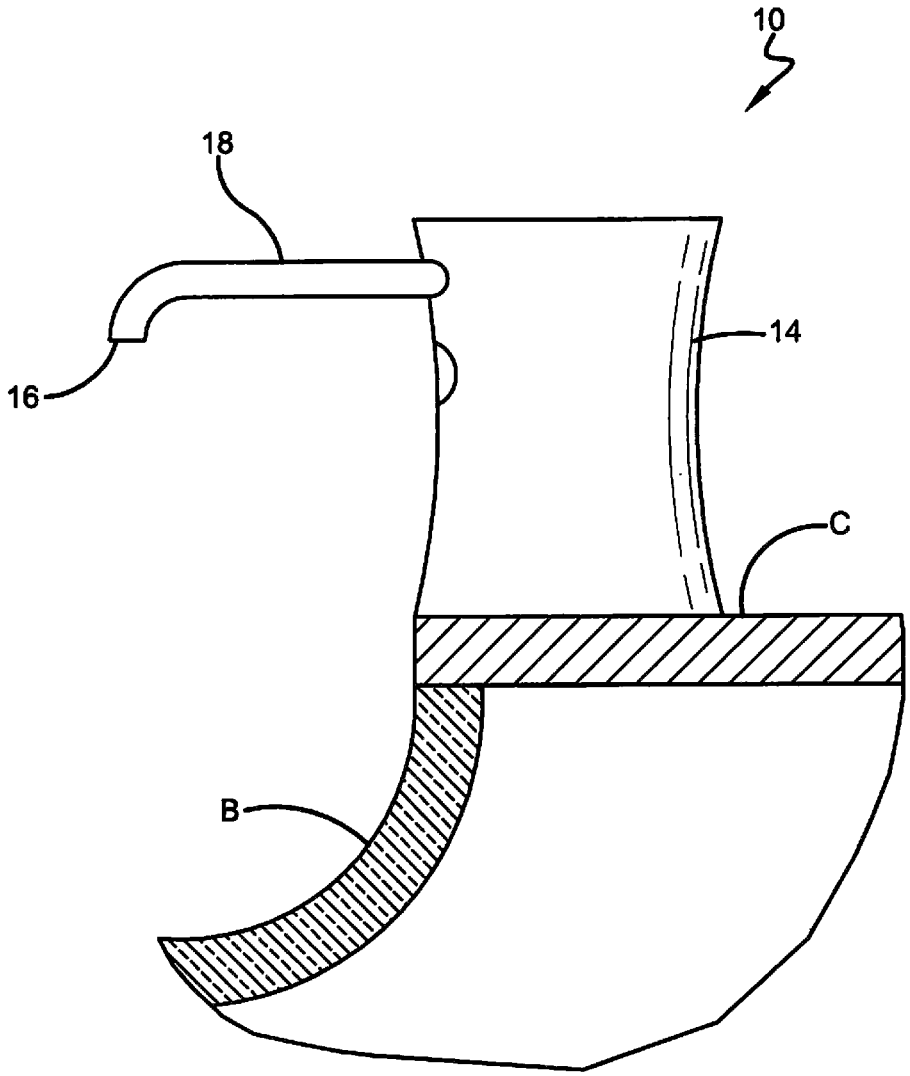
FIG. 1 PRIOR ART
FIG. 1 is a perspective view of a fully above-counter dispenser of the prior art.
Figure 2:
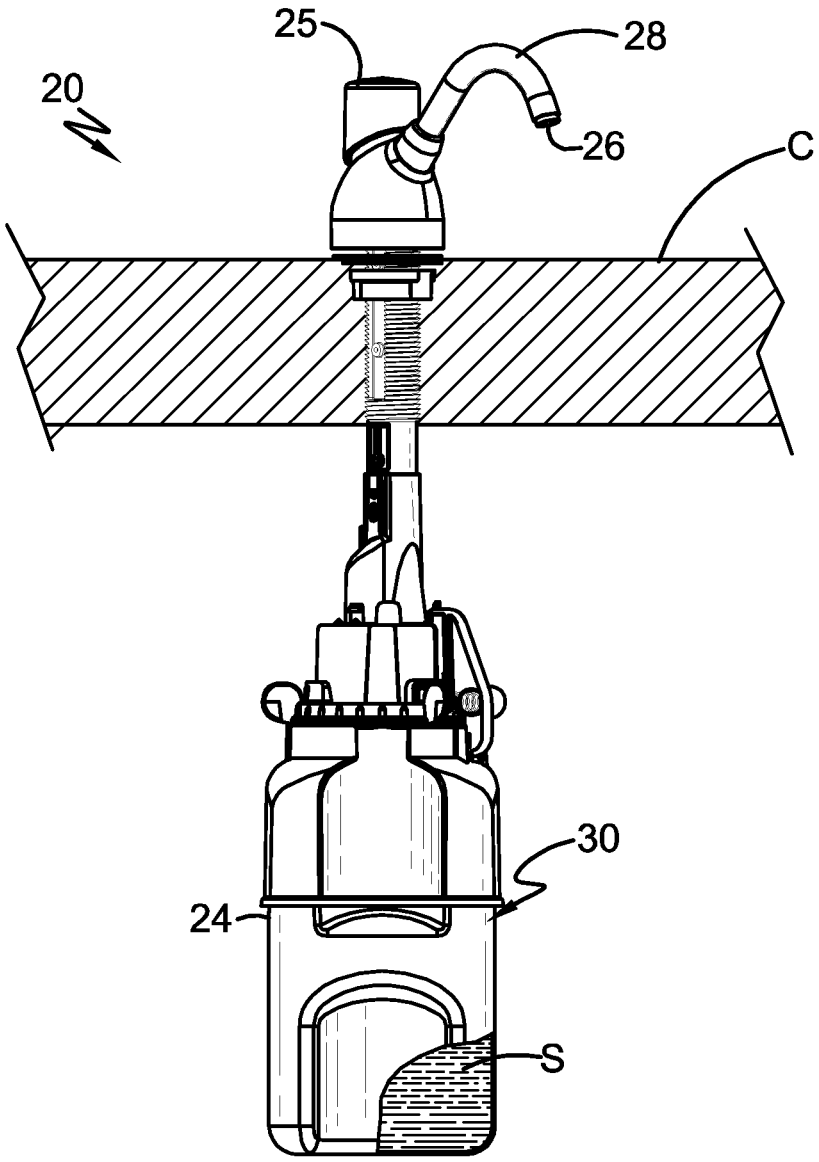
FIG. 2 PRIOR ART
FIG. 2 is a cross-sectional view of a counter-mounted soap dispenser of the prior art, wherein some elements are mounted above the counter and some below.
Figure 3:
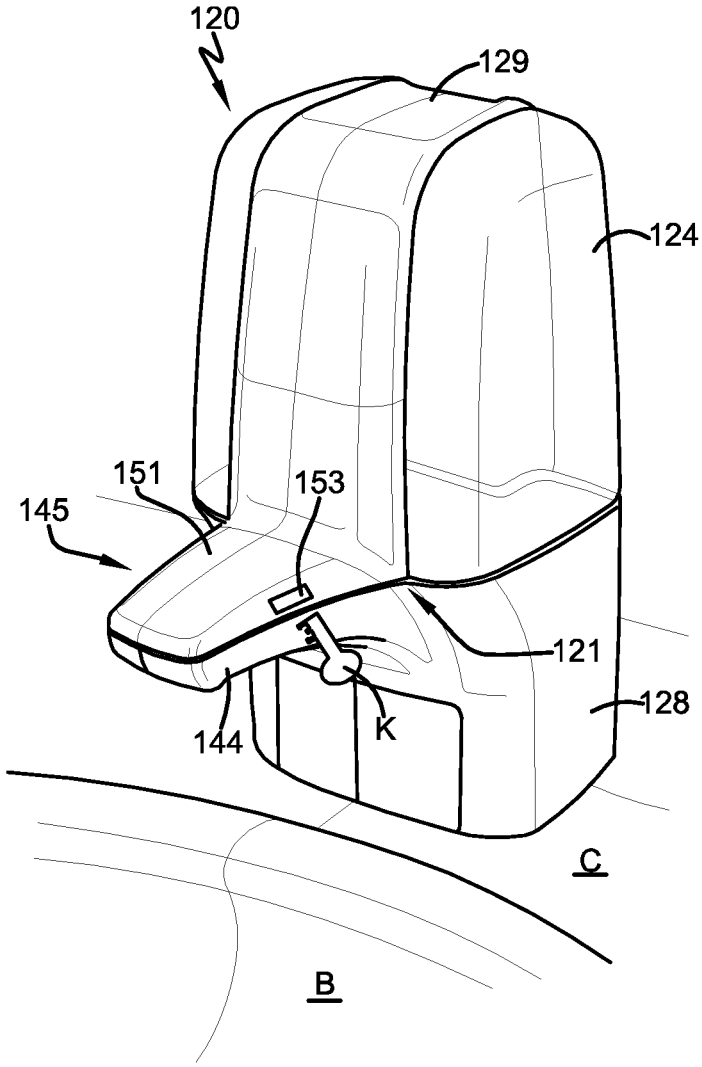
FIG. 3 is a perspective view of a first embodiment of a counter-mounted soap dispenser in accordance with this invention.
Figure 4:
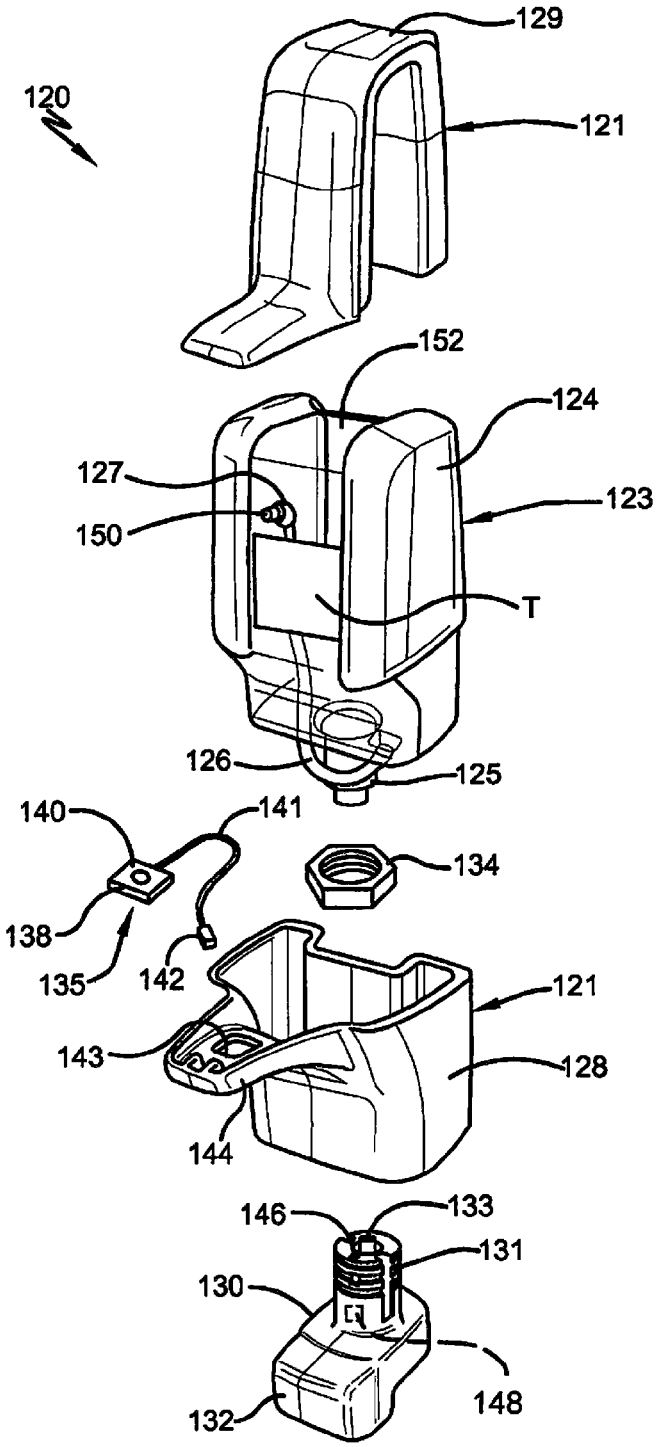
FIG. 4 is an assembly view of the first embodiment of FIG. 3.
Figure 5:
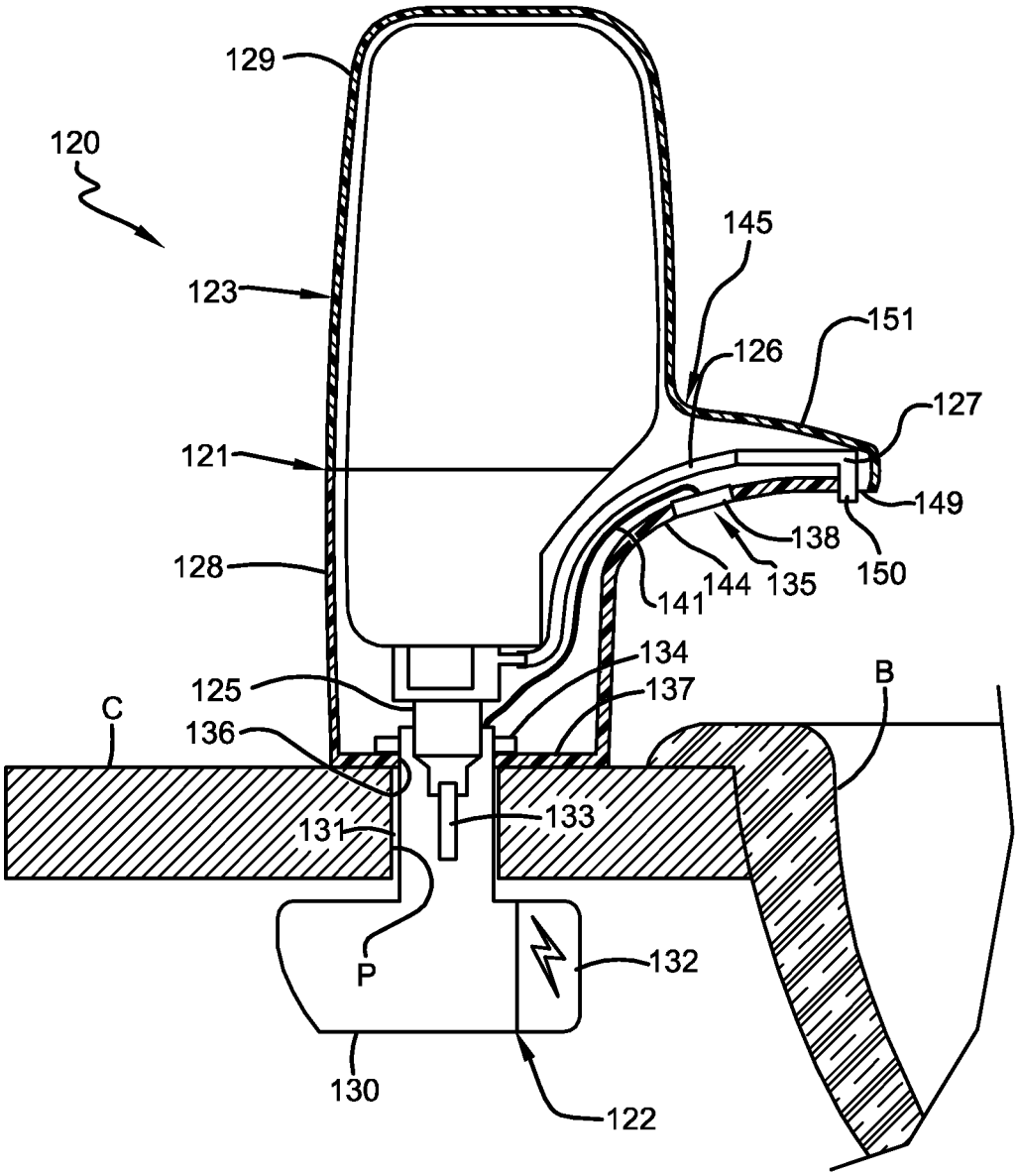
FIG. 5 is a side cross-sectional view of the first embodiment of FIG. 3, shown mounted to a counter.

Referring now to FIGS. 3-5, a first embodiment of a dispensing system in accordance with this invention is shown and designated by the numeral 120. The dispenser 120 includes a refill housing 121, an actuation unit 122 and a refill unit 123. The refill unit 123 includes a product container 124, a pump 125, a dispensing tube 126 and an outlet nozzle 127. The refill housing 121, includes a bottom shell 128 that selectively mates with a top shell 129 so that the refill housing 121 can be opened, for receipt of a refill unit 123, and closed over the refill unit 123 to secure it in the refill housing 121. The actuation unit 122 includes a body member 130 from which extends a bolt member 131. The body member 130 holds a power source, generally represented at numeral 132, and a pump actuator mechanisms schematically represented at 133. The dispensing system 120 further includes a nut 134 to interact with the actuation unit 122, particularly the bolt member 131 thereof. A sensor unit 135 is provided to permit the dispensing system 120 to be actuated without touching elements thereof.

As particularly appreciated in FIG. 5, an aperture 136 is formed through a bottom wall 137 of the bottom shell 128 of the refill housing 121. To mount the dispensing system to a counter C, the aperture 136 is aligned over the passage P, and the bolt member 131 of the actuation unit 122 is inserted from beneath the counter C, up through the passage P, such that the nut 134 can be threaded over the bolt 131 to clamp the bottom shell 128 to the top surface of the counter C. After securing the bottom shell 128 in this fashion, the sensor unit 135 can be affixed to communicate with the actuation unit 122. Particularly, the sensor unit 135 includes a sensor 138 and associated circuit board 140, a signal wire 141 and an interface plug 142. The sensor 138 and circuit board 140 are snap fit into a sensor receipt 143 in the bottom shell 128 (particularly in a bottom portion 144 of a spout body 145), and the interface plug 142 is plugged into a plug receipt 146 in the actuation unit 122 to interface with a circuit board 148 in the actuation unit 122. The refill unit 123 is then inserted in the bottom shell 128 in a pump-down orientation, with the pump 125 mating with the pump actuator mechanism 133 retained by the actuation unit 122. The bottom shell 128 defines a bottom portion 144 of a spout body 145, and an outlet receipt 149 is defined through the bottom wall of the bottom portion 144. With this structure, the dispensing tube 126 of the refill unit 123 is guided to lay within the spout body 145, with the outlet nozzle 127 being securely fitted to the outlet receipt 149 so that an outlet 150 of the outlet nozzle 127 points downwardly toward the top surface of the counter C or a sink basin B formed in the counter. In this embodiment, the dispensing tube 126 and its associated outlet nozzle 127 may be held to the container 124 by being secured thereto with a piece of adhesive tape T. This maintains a compact design wherein the flexible dispensing tube 126 is not loosely dangling from the pump 125. The tape T is obviously removed to permit the aforementioned placement of the dispensing tube 126 and outlet nozzle 127 in the spout body 145. After securing the dispensing tube 126 in the spout body 145, the top shell 129 is mated to the bottom shell 128 to complete the formation of the dispensing system 120. The top shell 129 provides a top portion 151 of the spout body 145 so as to form a complete, visually pleasing spout body 145 upon mating with the bottom shell 128.

In this embodiment, the container 124 of the refill unit is provided with a channel 152, and portions of the top shell 129 intimately fit within this channel 152, as shown in the figures, and serve to secure the refill unit 123 within the refill housing 121. With this structure, the contents of the container 124 are readily viewed to determine when it might be necessary to replace an empty refill unit 123. As shown in FIG. 3, the top shell 129 may, if desired, include a lock 153 for locking the top shell 129 to the bottom shell 128 to prevent its being opened absent the use of a key K.

Figure 6:
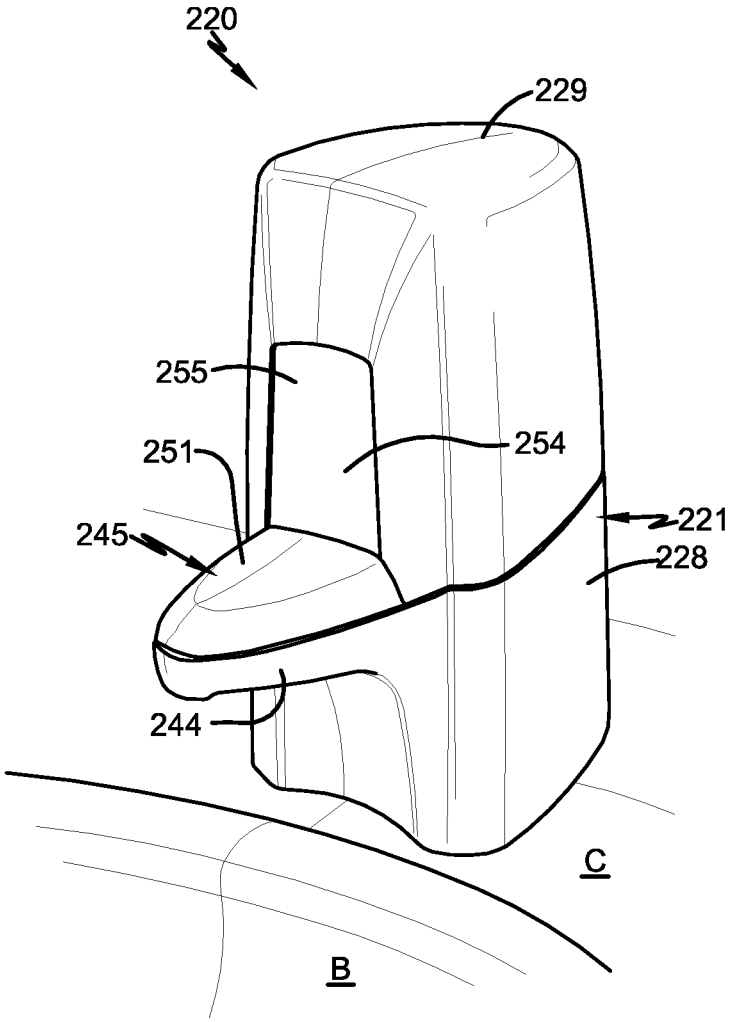
FIG. 6 is a perspective view of a second embodiment of a counter-mounted soap dispenser in accordance with this invention.
Figure 7:
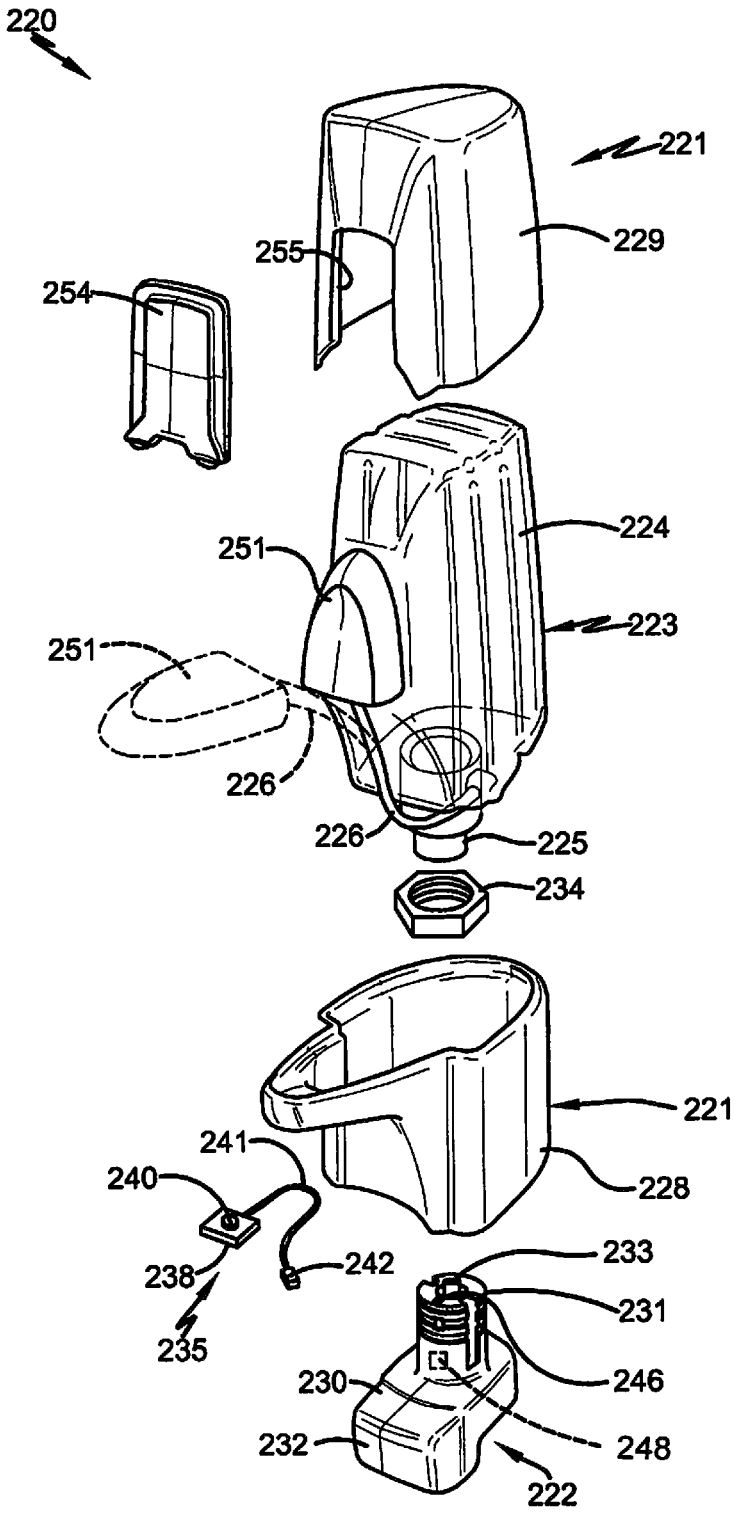
FIG. 7 is an assembly view of the second embodiment of FIG. 6.
Figure 8:
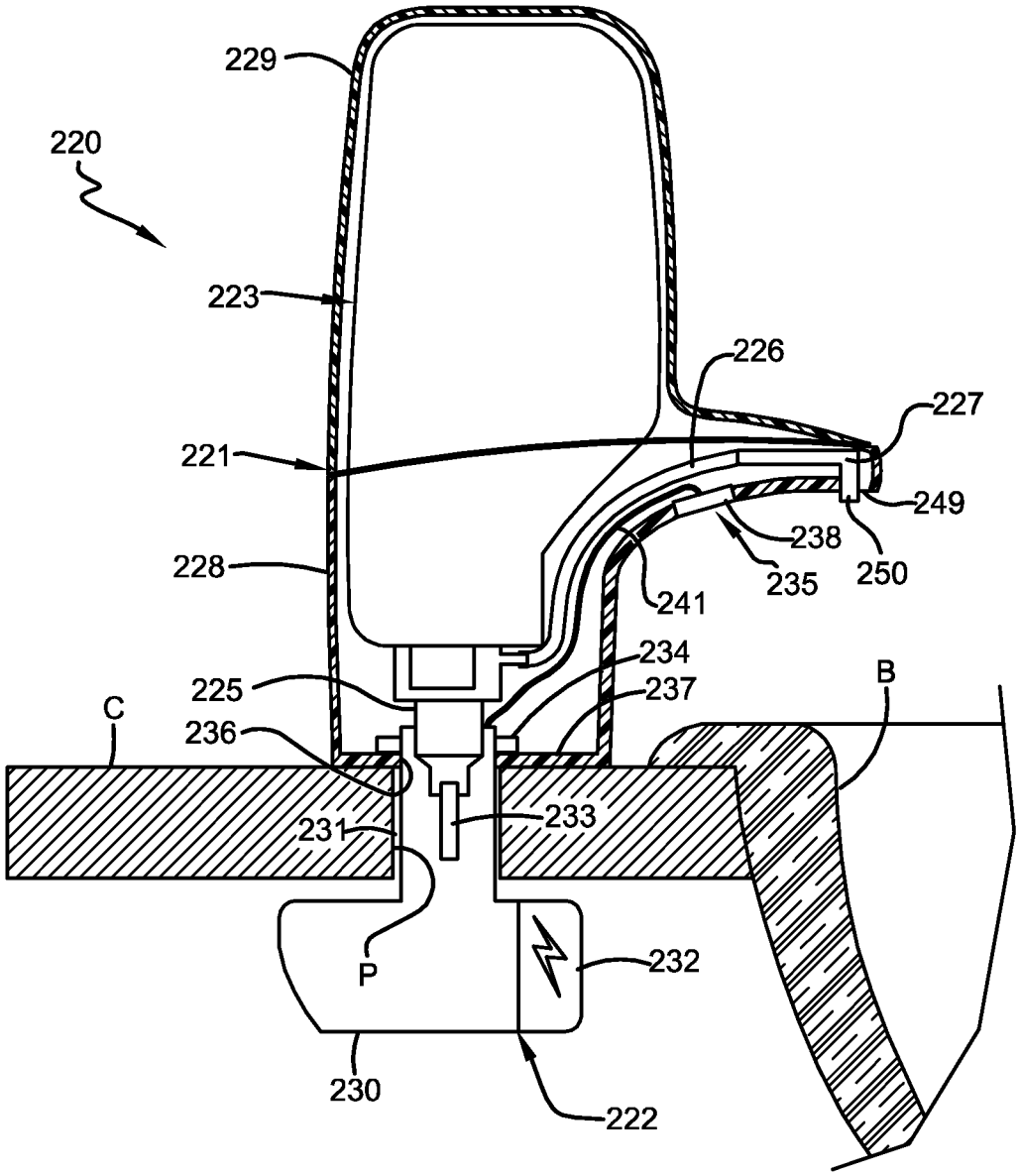
FIG. 8 is a side cross-sectional view of the second embodiment of FIG. 6, shown mounted to a counter.

Referring now to FIGS. 6-8, a second embodiment of a dispensing system in accordance with this invention is shown and designated by the numeral 220. In many respects, this embodiment is similar to that in FIGS. 3-5, so like parts receive like numerals though increased by 100. Thus, the dispenser 220 includes a refill housing 221, an actuation unit 222 and a refill unit 223. The refill unit 223 includes a product container 224, a pump 225, a dispensing tube 226 and an outlet nozzle 227. In this embodiment, the outlet nozzle 227 is retained by a top portion 251 of the spout body 245, as will be disclosed more fully below. The refill housing 221, includes a bottom shell 228 that selectively mates with a top shell 229 so that the refill housing 221 can be opened, for receipt of a refill unit 223, and closed over the refill unit 223 to secure it in the refill housing 221. The actuation unit 222 includes a body member 230 from which extends a bolt member 231. The body member 230 holds a power source, generally represented at numeral 232, and a pump actuator mechanisms schematically represented at 233. The dispensing system 220 further includes a nut 234 to interact with the actuation unit 222, particularly the bolt member 231 thereof. A sensor unit 235 is provided to permit the dispensing system 220 to be actuated without touching elements thereof.

As particularly appreciated in FIG. 8, an aperture 236 is formed through a bottom wall 237 of the bottom shell 228 of the refill housing 221. This embodiment is therefore mounted similar to the first embodiment. The aperture 236 is aligned over the passage P, and the bolt member 231 is inserted up through the passage P for engagement with the nut 234 to clamp the bottom shell 228 to the top surface of the counter C. After securing the bottom shell 228 in this fashion, the sensor unit 235 can be affixed to communicate with the actuation unit 222. Particularly, the sensor unit 235 includes a sensor 238 and associated circuit board 240, a signal wire 241 and an interface plug 242. The sensor 238 and circuit board 240 are snap fit into a sensor receipt 243 in the bottom shell 228 (particularly in a bottom portion 244 of a spout body 245), and the interface plug 242 is plugged into a plug receipt 246 in the actuation unit 222 to interface with a circuit board 248 in the actuation unit 222. The refill unit 223 is then inserted in the bottom shell 228 to mate the pump 225 with the pump actuator mechanisms 233 of the actuation unit 222. The bottom shell 228 defines a bottom portion 244 of a spout body 245, which is completed by a top portion 251 that, in distinction to the first embodiment represented by dispensing system 120, is provided as part of the refill unit 223 and carries the outlet nozzle 227 at the end of the dispensing tube 226. An outlet receipt 249 is defined through the bottom wall of the bottom portion 244 and the dispensing tube 226 and outlet nozzle 227 are properly laid up in the spout body 245, with the outlet nozzle 227 fitted within or at least aligned over the outlet receipt 249, when the top portion 251 is fitted to the bottom portion 244. Thus, the outlet 250 of the outlet nozzle 227 points downwardly toward the top surface of the counter C or a sink basin B formed in the counter. In this embodiment, to maintain a compact design, the top portion 251—and therefore the dispensing tube 226 and its associated outlet nozzle 227—may be held to the container 224 by snapping the structure of the top portion 251 into a detent or over a protrusion forming the exterior surface of the container 224. After securing the dispensing tube 226 in the spout body 245, the top shell 229 is mated to the bottom shell 228 to complete the formation of the dispensing system 220. In this embodiment, because the dispenser housing 221 formed by the mating of the bottom shell 228 and top shell 229, fully encloses the container 224 of the refill unit 223, a sight window 254 is preferably employed (though not necessary) so that means are provided for viewing the level of the product in the container 224. As seen in the assembly of FIG. 7, the sight window 254 can snap fit into a window receipt 255 in the top shell 229.

This embodiment could alternatively employ the refill unit channel and provide a top shell that fits within that channel, as in the first embodiment of FIGS. 3-5. This embodiment may also include a lock and key for opening and securely closing the housing 321, as mentioned in other embodiments.

Figure 9:
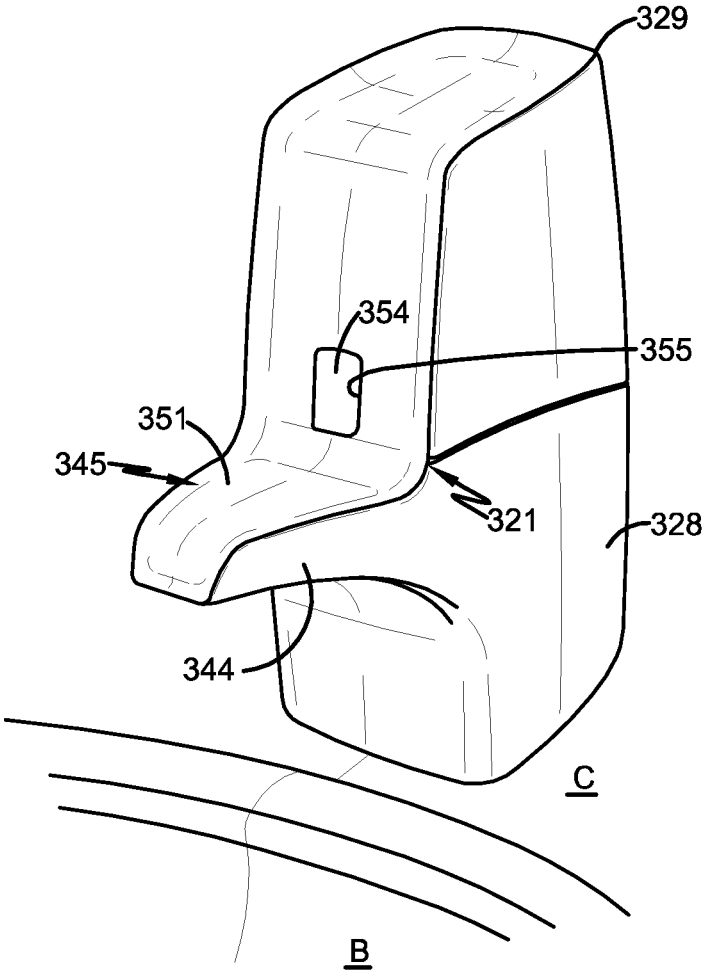
FIG. 9 is a perspective view of a third embodiment of a counter-mounted soap dispenser in accordance with this invention.
Figure 10:
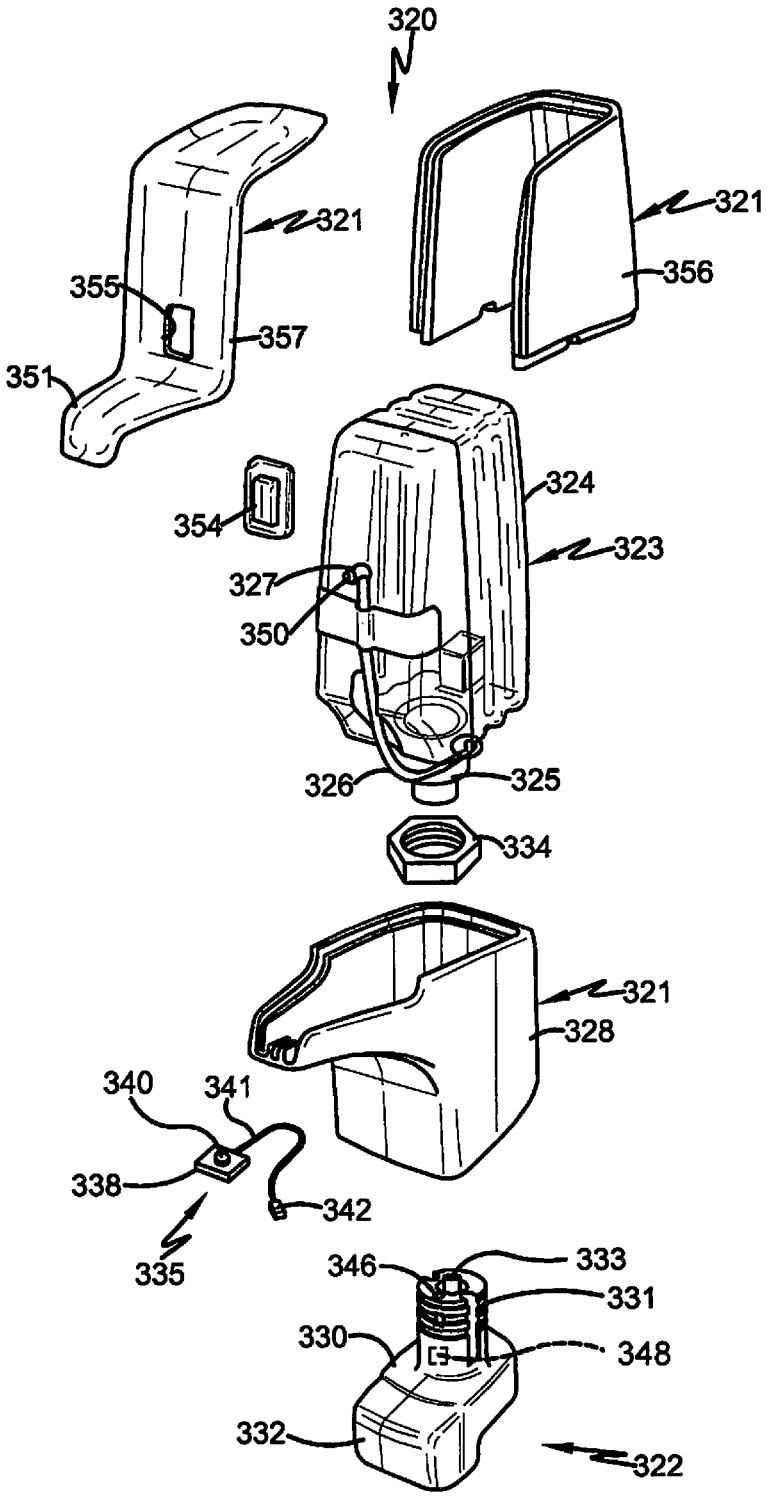
FIG. 10 is an assembly view of the third embodiment of FIG. 9.
Figure 11:
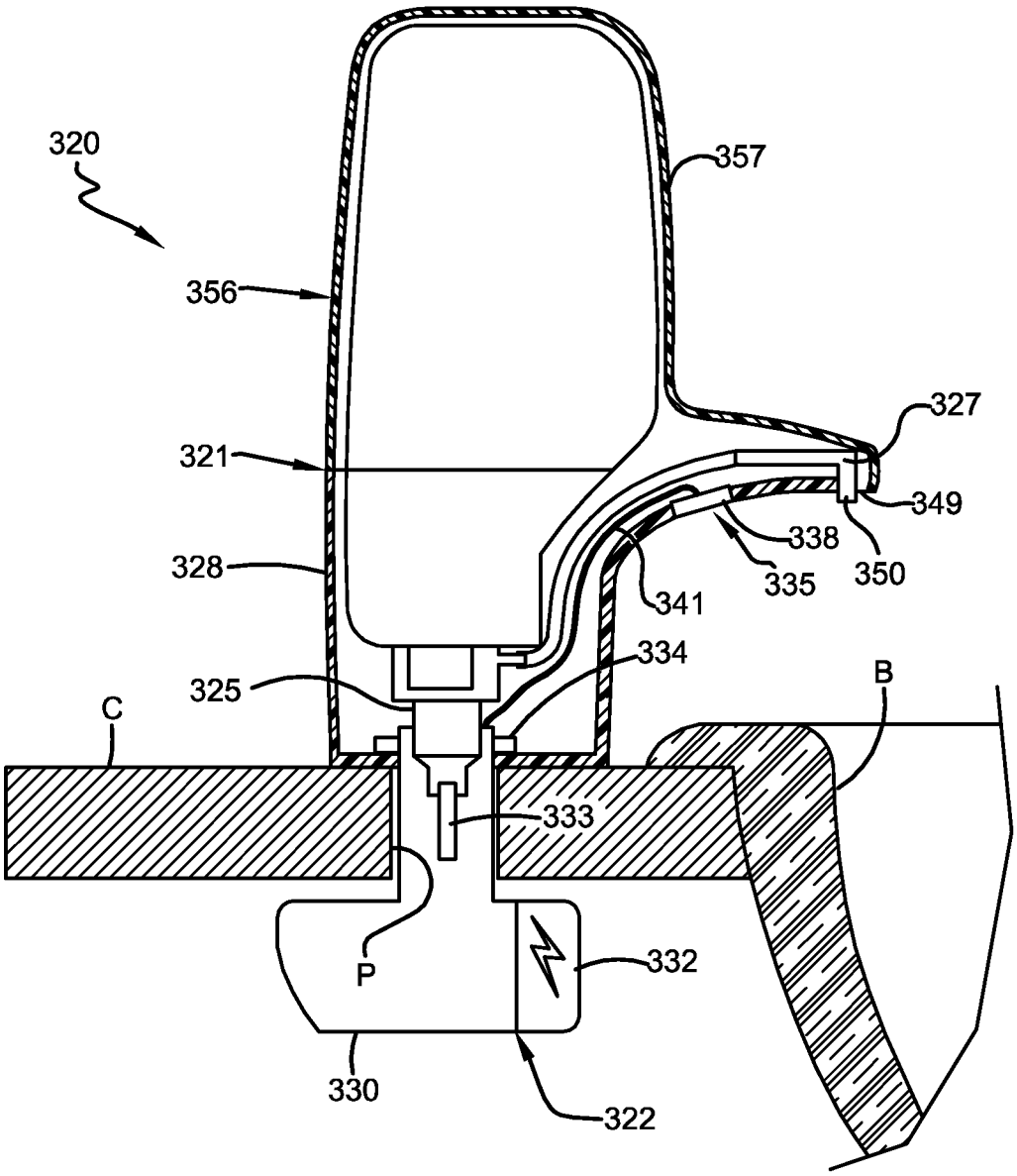
FIG. 11 is a side cross-sectional view of the third embodiment of FIG. 9, shown mounted to a counter.

Referring now to FIGS. 9-11, a third embodiment of a dispensing system in accordance with this invention is shown and designated by the numeral 320. In many respects, this embodiment is similar to that in FIGS. 3-5 and that in FIGS. 6-8, so like parts receive like numerals though increased by 200, as compared to FIGS. 3-5, and by 100 as compared to FIGS. 6-8. Thus, the dispenser 320 includes a refill housing 321, an actuation unit 322 and a refill unit 323. The refill unit 323 includes a product container 324, a pump 325, a dispensing tube 326 and an outlet nozzle 327. A bottom shell 328 selectively mates with a top shell 329, which, in this embodiment, is formed of multiple parts, a first top half 356 and a second top half 357. By removing at least the second top half 358 of the top shell 329, the refill housing 321 can be opened, for receipt of a refill unit 323. The top shell 329 closes over the refill unit 323 to secure it in the refill housing 321. The actuation unit 322 includes a body member 330 and a bolt member 331, and the body member 330 holds or otherwise communicates with a power source 332 and a pump actuator mechanism 333. A nut 334 interacts with the bolt member 231 to mount the dispensing system 320 to a counter C. A sensor unit 335 is provided to permit the dispensing system 320 to be actuated without touching elements thereof.

This embodiment is mounted similar to the first and second embodiments, with an aperture 336 in the bottom wall 337 aligned over a passage P in the counter C so that the bolt member 331 is inserted up through the passage P and mated with the nut 334 to clamp the bottom shell 328 to the top surface of the counter C. After securing the bottom shell 328 in this fashion, the sensor unit 335 can be affixed to communicate with the actuation unit 322. Particularly, the sensor unit 335 includes a sensor 338 and associated circuit board 340, a signal wire 341 and an interface plug 342. The sensor 338 and circuit board 340 are snap fit into a sensor receipt 343 in the bottom shell 328 (particularly in a bottom portion 344 of a spout body 345), and the interface plug 342 is plugged into a plug receipt 346 in the actuation unit 322 to interface with a circuit board 348 in the actuation unit 322. The refill unit 323 is then inserted in the bottom shell 328 to mate the pump 325 with the pump actuator mechanism 333 of the actuation unit 322. The bottom shell 328 defines a bottom portion 344 of a spout body 345, which is completed by a top portion 351 that, in distinction to the first and second embodiments of dispensing systems 120 and 220, is provided as part of the second top half 357 of the top shell 329. An outlet receipt 349 is defined through the bottom wall of the bottom portion 344 and the dispensing tube 326 and outlet nozzle 334 are properly laid up in the spout body 345, with the outlet nozzle 327 fitted within or over the outlet receipt 349, when the top portion 351 is fitted to the bottom portion 344. Thus, the outlet 350 of the outlet nozzle 327 points downwardly toward the top surface of the counter C or a sink basin B formed in the counter. To maintain a compact design, the dispensing tube 326 and its associated outlet nozzle 327 may be held to the container 324 by being secured thereto with a piece of adhesive tape T. After securing the dispensing tube 326 in the spout body 345, the first and second top halves 356 and 358 of the top shell 329 are mated to the bottom shell 328 (and to one another) to complete the formation of the dispensing system 320. In this embodiment, because the dispenser housing 321 formed by the mating of the bottom shell 328 and top shell 329, fully encloses the container 324 of the refill unit 323, a sight window 354 is preferably employed (though not necessary) so that means are provided for viewing the level of the product in the container 324. As seen in the assembly of FIG. 10, the sight window 354 can snap fit into a window receipt 355 in the top shell 329, particularly at second top half 358.

This embodiment could alternatively employ a refill unit channel and provide a top shell that fits within that channel, as in the first embodiment of FIGS. 3-5. This embodiment may also include a lock and key for opening and securely closing the housing 321, as mentioned in other embodiments.

The above disclosure mentions that the outlet nozzles 127, 227 and 327 may point toward a top surface of a counter C or toward a sink basin B. It will be appreciated that a sink basin B will preferably be positioned under the outlet nozzle 127, 227, 327 when the fluid to be dispensed is one that is preferably washed away after use. Liquid soap is a good example. A sink basin B is not always employed or desirable, as, for example, when the fluid to be dispensed is one that need not be washed away. Alcohol-based hand sanitizers are a good example. The dispensers in accordance with this invention can be employed to deliver a multitude of fluids to an end user, including soaps, sanitizers, lotions and the like, and the present invention is not to be limited to or by either the particular fluid dispensed or the mounting of the dispensing systems at a sink basin.

Although the particular embodiments described above include a threaded engagement of a bolt member 131, 231, 331 and a nut 134, 234, 334 to secure the housing 121, 221, 321 to the counter C at the bottom shell 128, 228, 328 thereof, it will be appreciated that other structures could be employed. For example, in some embodiments the distal end of the bolt member 131, 231, 331 could snap fit over the peripheral edge that defines the aperture 136, 236, 336. In other embodiments, the dispenser housing 121, 221, 321 could provide the bolt to extend through the passage in the counter to be engaged with a nut installed beneath the counter. Additionally, the top shell 129, 229, 329 and bottom shell 128, 228, 328 can fit together through snap-fitting structures or otherwise, because various mounting means are known in the art and need not be the focus of this invention disclosure.

The pump 125, 225, 325 may be any generally known or hereinafter discovered pump. Current generally known pumps include dome pumps, reciprocating piston pumps, gear pumps, flexible impeller pumps, and peristaltic pumps. The pump 125, 225, 325 may also be selected to be a pure liquid pump or a foam pump, which is know to advance both air and liquid, resulting in the dispersing of air bubbles in the liquid to create a foam. Whatever pump is employed may be actuated as generally known in the art. Typically, dome pumps include flexible domes that are actuated by cam members or reciprocating members that press against the dome to collapse the same and force the product within the dome toward the outlet. Similarly, reciprocating piston pumps are often actuated by carriages or rod members that are advanced, upon actuation of the dispenser, to cause the piston of the pump to reciprocate and advance product to the outlet. Peristaltic pumps are typically actuated by a roller mechanism that advances along the length of a collapsible tube that defines the peristaltic pump. Gear pumps and flexible impeller pumps are typically actuated through mechanisms causing the gears or impeller of the pump to rotate. In all such pumps, appropriate valves are included to regulate the flow of the product.

The present invention is not limited to or by any particular pump actuation mechanism. It is only required that the pump actuator mechanisms 133, 233, 333 actuate their respective pump 125, 225, 325 upon user demand. When the dispensing system 120, 220, 320 is actuated, fluid is advanced to the outlet 150, 250, 350 positioned in (or aligned with) the outlet receipt 149, 249, 349 of the spout body 145, 245, 345. The pump actuator mechanism 133, 233, 333 are actuated by the tripping of the sensor unit 135, 235, 335 in a generally known manner. The sensor 138 senses the presence of an individual's hand below the outlet 150, 250, 350 and, through the programming of the circuit board 140, 240, 340, associated with the sensor 138, 238, 338, and the circuit board 148, 248, 348, associated with the actuation unit 122, 222, 322, upon sensing the presence of the hand, sends a signal to the pump actuator mechanisms 133, 233, 333 to cause the actuation of the pump 125, 225, 325 and advance product S to the outlet 150, 250, 350.

The dispensing tube 126, 226, 326, communicating between the pump 125, 225, 325 and the outlet 150, 250, 350 may be formed of a single tube, as in the case of simple liquid dispensing, or of multiple tubes, in the case of foam dispensing. When multiple tubes are employed, they may be separate and distinct tube (for example, arranged in a side-by-side relationship) or coaxial tubes. As generally known, some fluids can be dispensed as liquids (or gels) and some can be dispensed as either liquids (or gels) or foams. In foams, air is incorporated into the liquid to form a foam product. Thus, when a foamed product is being dispensed, the dispensing tube 126, 226, 326 will include both a liquid tube and an air tube, with the air and liquid advanced through the tubes being appropriately joined proximate the outlet 150, 250, 350 usually through a foam generator member including a mesh screen or other structure that serves to disperse and homogenize air bubbles throughout the liquid to create a high quality foam.

Although it has been disclosed above that the dispensing tube 126, 226, 326 (whether of a single tube or multiple tubes) is provided as part of the refill unit 123, 223, 323—and is particularly attached to the outlet of the pump 125, 225, 325—the dispensing tube 126, 226, 326 may be provided as part of the refill housing 121, 221, 321, with the pump 125, 225, 325 of the refill unit 123, 223, 323 being adapted to communicate with the dispensing tube 126, 226, 326 when the refill unit 123, 223, 323 is mounted in the refill housing 121, 221, 321. Providing the dispensing tube 126, 226, 326 as part of the refill unit is typically more preferred, because the dispensing tube 126, 226, 326 and outlet nozzle 127, 227, 327 (and any foam generating member therein, if employed) will be installed along with a new refill unit 123, 223, 323, and removed along with a refill unit 123, 223, 323 that is empty or otherwise in need of replacement. This replacing of the container 124, 224, 324, pump 125, 225, 325, dispensing tube 126, 226, 326, and outlet nozzle 127, 227, 327 (and any foam generative member therein) is desirable because those parts are wetted parts, i.e., they come into contact with the wet fluid advancing therethrough and thus are susceptible to some contamination over time. Particularly in the hand-hygiene arts (for example, soap and sanitizer dispensing arts), it is desirable that wetted parts be periodically replaced.

Although accommodations can be made for feeding the at least one dispensing tube to the outlet of the spout regardless of how the dispensing tube is associated with the pump of the refill unit, in particular embodiments of this invention, the at least one dispensing tube extends from the pump somewhat parallel to the counter so that it can be more easily fed to the outlet of the spout. In particular embodiments such as those shown herein, where the refill unit is inserted in a vertical direction, the dispensing tube would preferably extend from the pump in a direction crossing the vertical plane. The benefits of having a dispensing tube that extends from the pump in this manner can be appreciated in the various figures in this disclosure, wherein the dispensing tube, which is typically flexible, is easily laid up and into the spout to extend to the outlet receipt. Various pumps can be adapted to provide such an dispensing tube structure, for example, through appropriate valves and inlet and outlet passages. Gear pumps are readily capable of being designed in this manner, and, in the orientation of FIGS. 5, 8 and 11, the pump actuator mechanisms 133, 233, 333 could be provided as a motor rotating shaft, which is generally shown in the aforementioned figures, to engage a gear of the pump 125, 225, 325 and rotate the same, with the outlet for the gear pump crossing, and in some embodiments being parallel to, the axis of the shaft.

In some embodiments of this invention, the pump 125, 225, 325 is selected to be a reciprocating piston pump, and the pump actuator mechanisms 133, 233, 333 is provided as a reciprocating shaft that engages a reciprocating piston of the pump and causes the same to reciprocate in a housing to advance the product to the outlet nozzle 127, 227, 327. Common reciprocating piston pumps usually draw the fluid from a container in a direction along the axis in which the piston reciprocates, and also expel the fluid from the pump through a dispensing tube that initially extends along that same axis. In many commercial embodiments, the dispensing tubes are connected to the reciprocating piston member such that the tubes reciprocate along with the piston member. This can be seen for example, in U.S. Pat. No. 6,131,342, wherein, were that container and pump (i.e., refill unit) to be incorporated into the present invention, the dispensing tube would crowd the actuating mechanisms and would have to be fed through a circuitous route to dispense at the ultimate outlet of the spout. Thus mention has been made of employing pumps with outlets extending somewhat parallel to the counter. For refill units that employ reciprocating piston pumps actuated in a vertical direction (as in the orientation shown in FIGS. 5, 8 and 11), providing the desired pump outlet would require forming the pump with an outlet that extends in a direction crossing the plane in which the piston reciprocates, as opposed to having the dispensing tube extend axially from and reciprocate axially with the piston member. Thus, in embodiments where the pump 125, 225, 325 is a reciprocating piston pump actuated in the vertical direction (as in the orientation of FIGS. 5, 8, 11), the pump 125, 225, 325 preferably is formed with a pump outlet 131, 231, 331 that intersects with the vertical plane in which reciprocates the piston of the pump 125, 225, 325.

Figure 12:
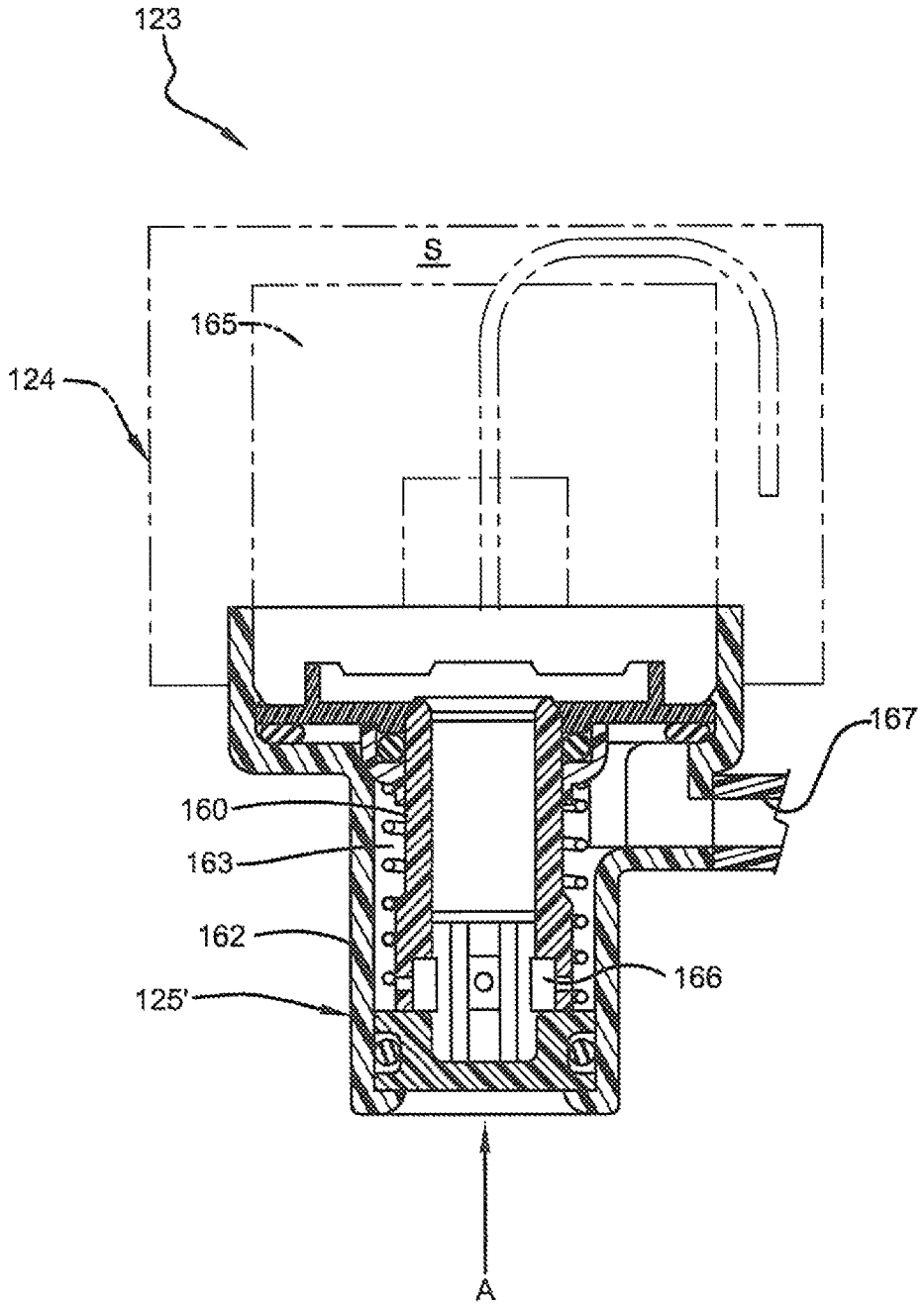
FIG. 12 PRIOR ART
FIG. 12 is a schematic cross-sectional view of an embodiment of a reciprocating piston pump that may be found to be particularly useful for the present invention and relates to the pump shown in U.S. Pat. No. 7,431,182.

Particularly suitable reciprocating piston pumps are disclosed in published U.S. Pat. No. 7,431,182, and the entirety of that patent is incorporated herein by reference. With reference to FIG. 12, it can be seen that a particular pump that could be useful as pump 125, 225 or 325, is designated by the numeral 125'. Certain well-known elements are schematically represented, while those elements more germane to the desired aspects of this pump are represented in more detail. The pump 125' communicates with a container 124 to form a refill unit 123, which retains a liquid S. The pump 125' includes a piston 160 that is retained for reciprocal movement relative to a stationary outer housing 162. This creates a stationary outlet chamber 163 between the inner diameter of the housing 162 and the outer diameter of the piston 160. The pump 125' includes a liquid chamber 164 and, if a foam is to be dispensed, an air chamber 165, each such chamber being well known in the art. When the piston 160 is forced in the direction of arrow A, each chamber (air and/or liquid) would be acted upon to force liquid (and air, if the pump is a foam pump) into and through the piston 160, the liquid (and air, in the case of a foam pump) exiting the piston 160 at the outlet 166 and entering the stationary outlet chamber 163. The stationary outlet chamber 163 provides the ultimate outlet for the pump 125' at port 167, where a dispensing tube could be attached. Thus, a pump such as pump 125' could be used in the environments depicted in FIGS. 5, 8 and 11, and a reciprocating rod could actuate the pump 125' in a vertical direction, with the liquid advancing from the pump 125' exiting at a port 167 extending in a direction crossing the vertical (for example, the horizontal direction seen in FIG. 12).

As mentioned, the pump actuator mechanism 133, 233, 333 is operated by appropriate sensors and microprocessors to provide a touchless dispensing system as is well known in the art. A sensor 138, 238 338 at the underside of spout body 145, 245, 345 senses the presence of an individual's hand under the outlet 150, 250, 250, and sends a signal to the pump actuator mechanism 133, 233, 333, causing it to actuate the pump 125, 225, 325. In dome pumps, the pump actuator mechanism would collapse the dome to advance product. In reciprocating piston pumps, the pump actuator mechanism would advance a piston member in a chamber to advance product. In gear pumps and flexible impeller pumps, the pump actuator mechanism would rotate the gears or impeller to advance product. In peristaltic pumps, the pump actuator mechanism would advance a roller mechanism over the peristaltic pump tube to advance product.

Mention has already been made that this invention could be practiced to dispense liquid products or foamed products. As known, foam products, and particularly foamed soaps and foamed sanitizers, are generally dispensed by employing pumps that advance air and either liquid (soap) or gel (sanitizer), and mix the same, usually though screens, to create bubbles of air in the liquid and produce a foam. In particularly embodiments of this invention, the pump of the refill unit could simply be a foam pump having both air-advancing and liquid advancing means, such that, when the pump is actuated, a foam is produced. This foam can be produced directly at the pump or separate liquid and air dispensing tubes could advance from the pump to a foam generator positioned at the outlet of the dispenser such that the air and liquid advanced by the pump are kept separate before mixing in the foam generator, directly before the outlet. In yet other embodiments, the pump of the refill unit can provide the advancing of liquid to a distant foam generator, while a separate pump not associated with the refill unit provides the advancing of air to the same foam generator. Such an embodiment is shown in FIG. 13, which will be described more particularly below.

Figure 13:
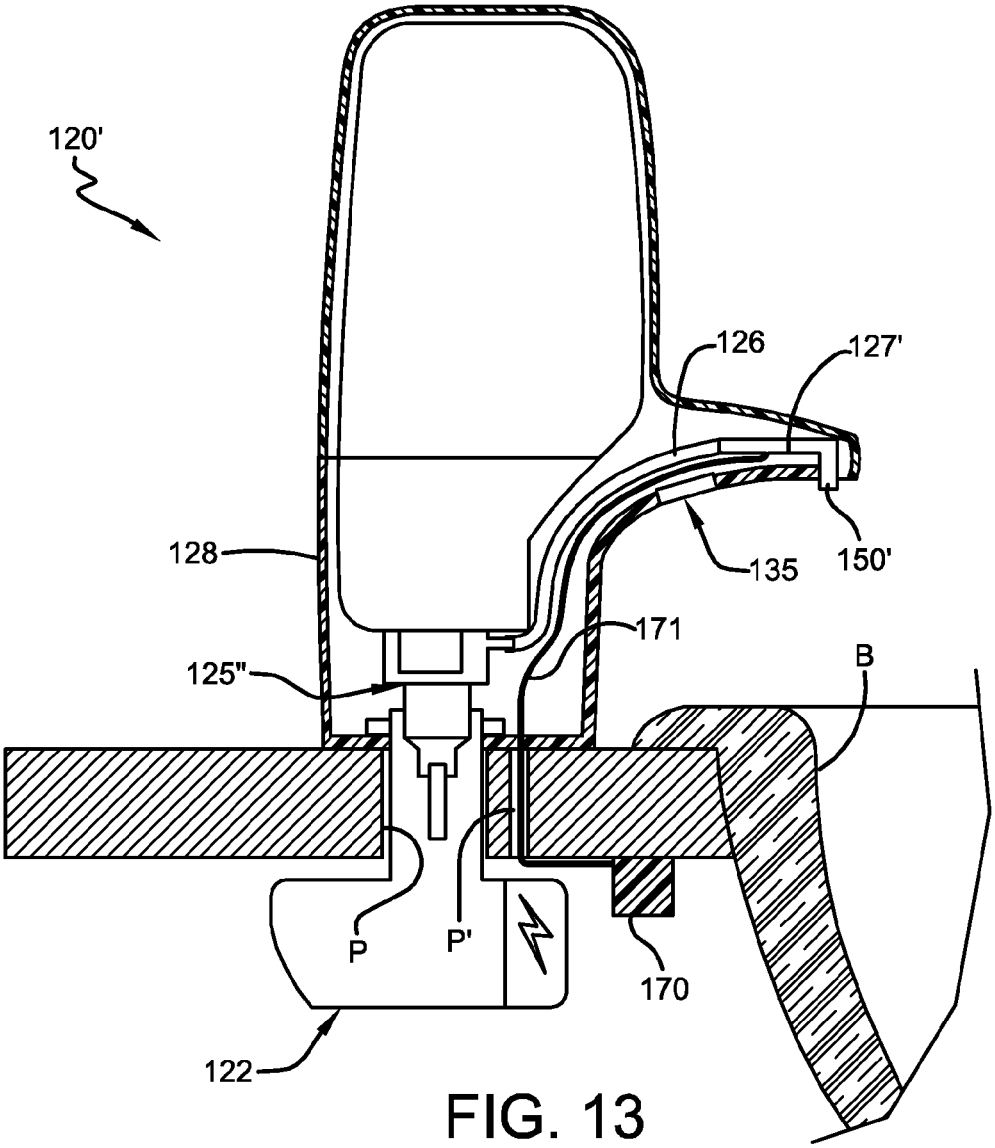
FIG. 13 is a cross-sectional view of a counter-mounted soap dispenser of this invention, similar to those embodiments of FIGS. 3-11, but in which the liquid product is dispensed as foam through the use of an air pump disassociated from the liquid pump.

The dispensing system 120' of FIG. 13 shows the embodiment of FIGS. 3-5, but it is to be understood that the pump 125" therein is a pump that only advances liquid (i.e., it is not a foam pump that would advance both air and liquid). With this understanding, the pump 125" can be virtually any pump that advances liquid only, and these pumps include, without limitation, dome pumps, reciprocating piston pumps, gear pumps, flexible impeller pumps, and peristaltic pumps. Each such pump may be actuated as generally known in the art. The dispensing system of FIG. 13 is made a foam dispensing system by way of including an air pump 170. Foam is produced by mounting an air pump 170 as a more permanent part of the dispensing system, either below the counter C (as shown) or above the counter C or within the dispenser housing 121, and associating that air pump 170 with a modified outlet nozzle 127' (similar to nozzle 127, but adapted for this particular embodiment) and the sensor unit (similar to unit 135) so that the air pump 170 is actuated at the same time as the liquid only pump 125". Actuation occurs upon tripping the sensor unit 135, which, in this embodiment, communicates with both the air pump 170 and the liquid only pump 125" as known, to cause each pump to actuate when a user places their hand appropriately to trip the sensor.

Figure 14:
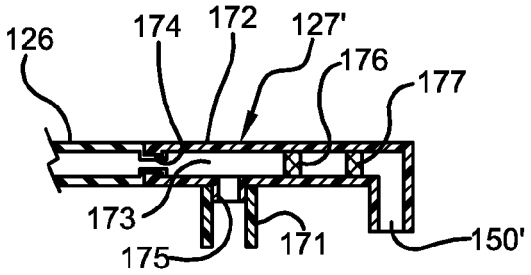
FIG. 14 is a cross-sectional view of an outlet nozzle useful for the embodiments of FIG. 13 and FIGS. 15-18.
Figure 15:
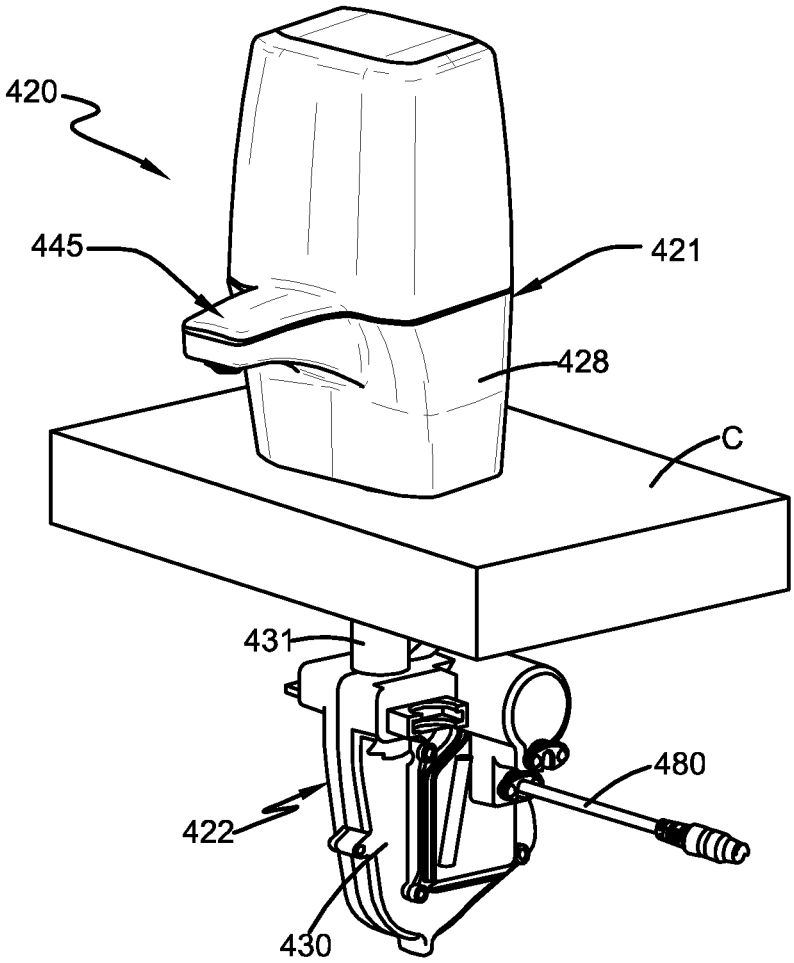
FIG. 15 is a perspective view of another embodiment of a counter-mounted dispenser in accordance with this invention.
Figure 16:
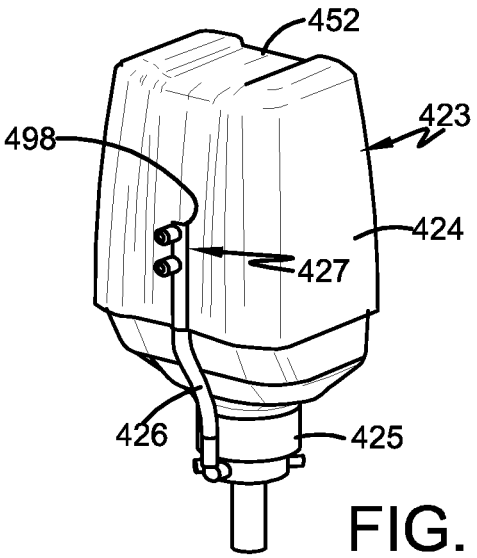
FIG. 16 is a perspective view of a refill unit for the embodiment of FIG. 15.
Figure 17:
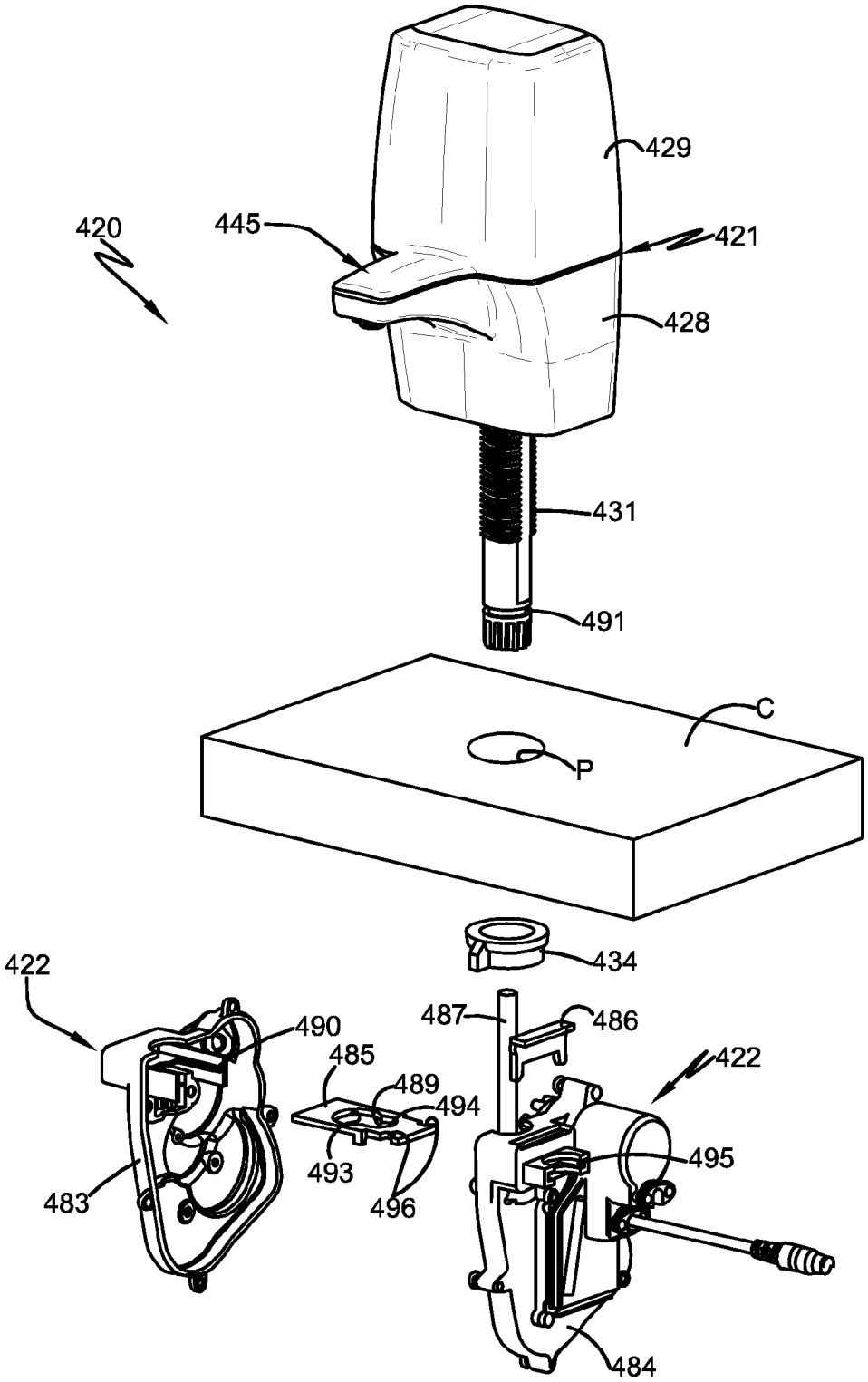
FIG. 17 is an assembly view of the embodiment of FIG. 16.
Figure 18:
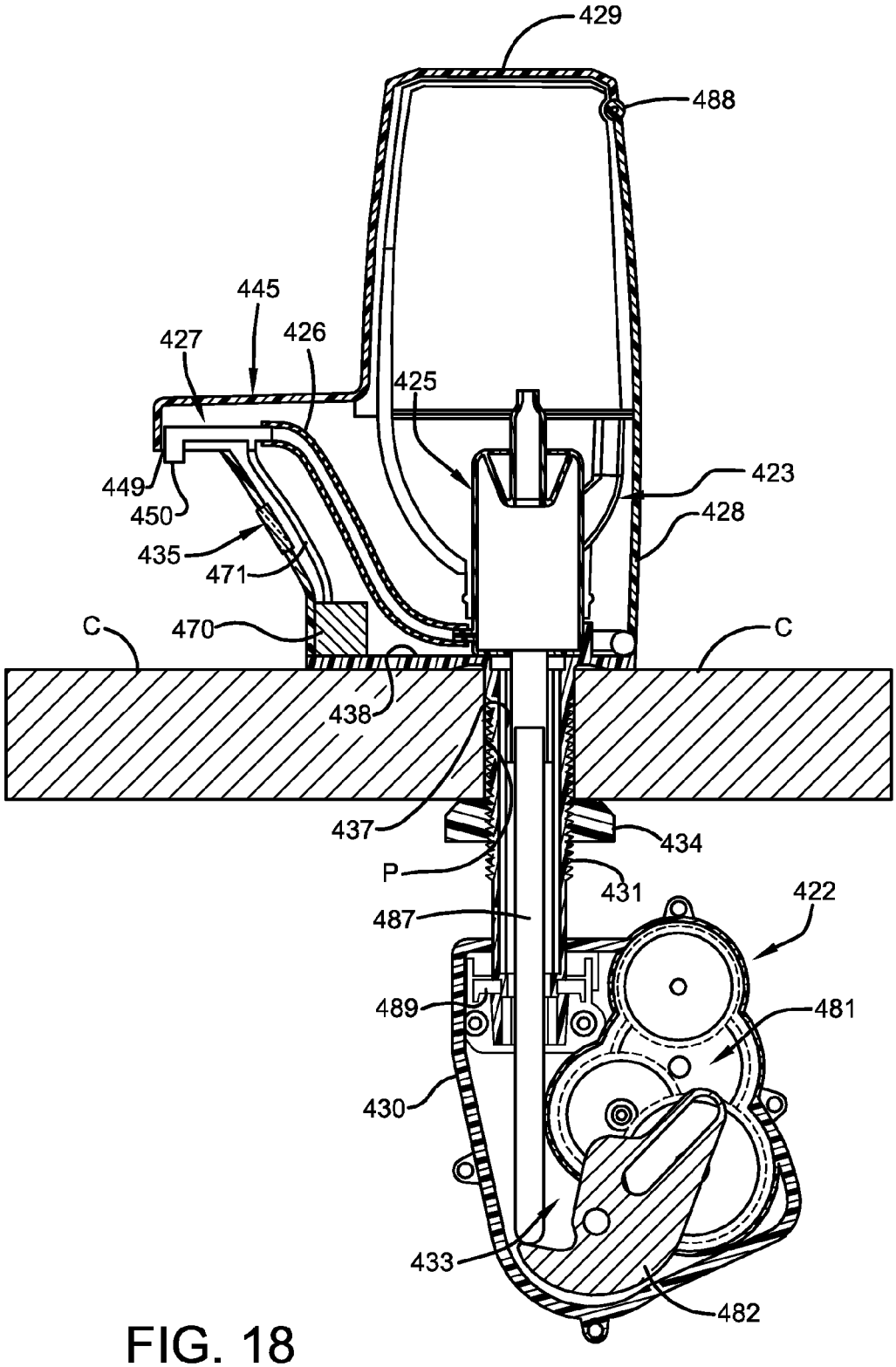
FIG. 18 is a cross-sectional view of the dispenser of FIG. 15.

The air pump 170 includes an air tube 171 through which the air is advanced upon actuation of the air pump 170. This air tube 171 extends through a passage P2 in the counter, but it could alternatively extend through passage P. Because the air pump 170 is mounted below the counter C, it will also preferably extend through an aperture in the housing 128 it extend through the interior thereof and connect to the modified outlet nozzle 127'. With particular reference to FIG. 14, the outlet nozzle 127' includes a body 172 that defines an outlet passageway 173 and receives liquid advance through the dispensing tube 126 by the liquid pump 125" at liquid port 174, and receives air advanced through the air tube 171 by the air pump 170 at air port 175. The air and liquid advanced to the outlet nozzle 127' are forced through first and second mesh screens 176, 177 positioned in the outlet passageway 173. The screens 176, 177 serve as a foam generator, causing air bubbles to disperse through the liquid to make foam that is dispensed at outlet 150'.

Notably, this dispensing system 120' produces foam but employs a refill unit 123' that is significantly reduced in cost as compared to a refill unit carrying a foam pump that advances both air and liquid. The pump 125", being only a liquid pump, will be smaller and cost less than would a foam pump. While it is desired for reasons of sanitation to replace the pumps and tubes that carry liquid, the same is not necessary for the pumps and tubes that carry air, such that the air pump 170 and air tube 171 can be more permanent structures of the dispensing system that are only replaced (or simply repaired) if they break down or fail to function properly.

It should be noted that in each of the embodiments disclosed herein, the refill unit and the passage through the counter may be structured, as shown, such that the pump partially extends into the passage to be actuated by elements of the pump actuator mechanism that extend into the passage to engage the pump. However, they may also be structured such that the pump rests wholly above the counter to be actuated by elements of the pump actuator mechanism that extend through the passage to engage the pump. They may also be structured such that the pump of the refill unit extends below the counter to be actuated by elements of the pump actuator mechanism that are positioned below the counter. The broadest benefit to the present invention is the mounting of refill units at a position above the counter, with the actuation elements being mounted at a position below the counter.

A final specific embodiment of a dispensing system of this invention is shown in FIGS. 15-18 and is designated by the numeral 420. In many respects, this embodiment is similar to that in FIGS. 3-5, FIGS. 6-8 and FIGS. 9-11, so like parts receive like numerals though increased by 300, as compared to FIGS. 3-5, by 200 as compared to FIGS. 6-8 and by 100 as compared to FIGS. 9-11. Distinctions relevant to this embodiment will of dispensing system 42 will be made apparent even if similar numerals are employed. Thus, the dispenser 420 includes a refill housing 421, an actuation unit 421 and a refill unit 423. The refill unit 423 includes a product container 424, a pump 425, a dispensing tube 426 and an outlet nozzle 427, which is similar to the modified outlet nozzle 127' of FIG. 14. Notably, the pump 425 is a pump that advances liquid only, such that, in embodiments where a foam product is to be dispensed, the dispensing system 420 would further include an air pump 470, substantially as disclosed with respect to the air pump 170 of the embodiment of FIG. 13. A bottom shell 428 selectively mates with a top shell 429 through a hinge 488. In this embodiment, the top shell 429 is formed like the top shell 129 to fit into a channel 452 formed in the refill unit 423. By removing the top shell 429, the refill housing 421 can be opened, for receipt of a refill unit 423. The actuation unit 422 includes a body member 430 that is mounted to a bolt member 431, which, in this embodiment, is provided extending downwardly from the bottom wall 438 of the bottom shell 429. The actuation unit 422 communicates with a power source through a wire 480, but the actuation unit 422 could be battery powered, if desired. This actuation unit 422 includes pump actuator mechanisms 433 in the form of a rod 487 that is reciprocated by the action of gears 481 and a cam 482. A nut 434 interacts with the bolt member 431 to mount the bottom shell 428 to the counter C. A sensor unit 435 is provided to permit the dispensing system 420 to be actuated without touching elements thereof. The sensor unit 435 communicates with both the air pump 470 and the liquid only pump 425 as known, to cause each pump to actuate when a user places their hand appropriately to trip the sensor.

This embodiment is mounted in a manner similar to but with structure and steps distinct as compared to prior embodiments. The bottom shell 428 includes an aperture 437 in the bottom wall 438, the aperture 437 being defined by the bolt member 431, which extends downwardly from the bottom wall 438 and is hollow. The bolt member 431 is aligned over a passage P in the counter C so that the bolt member 431 is inserted down through the passage P and mated with the nut 434 to clamp the bottom shell 428 to the top surface of the counter C. After securing the bottom shell 428 in this fashion, mating first and second halves 483 and 484 of the actuation unit 422 are mounted to the bolt member 431 by a plate 485 and pin 486. The plate 485 includes an aperture having a first circumferential section 493 and a second, small diameter circumferential section 494 that defines a flange 489. The plate 485 rests in a track 490 defined in the body member 430 and can move therein to engage flange 489 with a channel 491 in bolt member 431. Particularly, the plate 485 freely slides in the track 490 and is positioned therein so that the bolt member 431 is inserted through the first circumferential section 493. The plate 485, which extends through the open end 495 of track 490, is then slid in the track 490 so that the second circumferential section 494 engages the track 491 on the bolt member 431. This holds the actuation unit 422 to the bolt member 431, and the engagement is secured by engaging pin 486 with the pin receipt 496 on the plate 485 by inserting the pin 486 through the slot 497 in the body member 430. The actuation unit 422 is mounted so that the rod 487 of the pump actuator mechanisms 433 extends up into the hollow extension of the bolt member 431 to engage the pump 425.

The sensor unit 435 can then be affixed to communicate with the actuation unit 422 and the separate air pump 470 substantially as known in the art. Particularly, the sensor unit 435 includes a sensor and associated circuit board, signal wires and interface plugs to communicate with circuit boards associated with the air pump 470 (if employed) and pump actuator mechanisms 433 to actuate the air pump 433 (if employed) and liquid pump 425.

The refill unit 426 is then inserted in the bottom shell 428 to contact the pump 425 with the rod 487 of the actuation unit 422. As with other embodiments, the top and bottom shells 429, 428 define a spout body 445, and the dispensing tube 426 and outlet nozzle 427 are properly laid up in the spout body 445, with the outlet nozzle 427 fitted within or over the outlet receipt 449. Thus, the outlet 450 of the outlet nozzle 427 points downwardly toward the top surface of the counter C (or a sink basin, not shown). To maintain a compact design, the dispensing tube 426 and its associated outlet nozzle 427 may be held to the container 424 by a detent 498 formed in the front wall of the container 424. After securing the dispensing tube 426 in the spout body 445, the top shell 438 is mated to the bottom shell 428 (by pivoting at hinge 488) to complete the formation of the dispensing system 420.

When a user requires a dose of product from the dispensing system 420, he places his hand under the outlet 450, and the sensor unit 435 sends the appropriate signal to the actuation mechanisms 433 and the air pump 470. Upon receiving the signal from the sensor unit 435, the cam 476 of the actuation mechanisms 433 is caused to rotate on a pivot pin 499. The cam 476 provides a cam tip 500 on one side of the pivot pin 499 and a cam slot 501 at an opposite side. A cam drive gear 502 carries a shaft 503 extending from the cam drive gear 502 at an off-center position. The shaft 503 engages the cam slot 501 so that, when the cam drive gear 502 is rotated, the cam 476 oscillates between clockwise and counterclockwise rotation and that the cam tip 500 causes the rod 487 to reciprocated up and down and thus actuate the pump 425 inasmuch as, for this embodiment, the pump 422 is a form of a reciprocating piston pump. The rod 474 can either engage a portion of the pump 422 extending into the passage P or engage the pump above the counter C.

In any and all embodiments, the sensor units for hands-free dispensing (i.e., dispensing without having to physically contact the dispenser) can be either hardwired to circuit boards associated with the actuation mechanisms for the various pumps employed, or can communicate with the actuation mechanisms wirelessly through appropriate radio frequency or other means to cause the same to operate upon the sensing of a hand under the outlet of the dispensing system.

Notably, the present invention substantially improves the art by providing a counter-mounted dispensing system wherein the refill unit containing the product to be dispensed can be removed and replaced at the top side of the counter. Thus, service personnel do not have to crouch down underneath the counter and do not have to deal with the interference caused by the sink basin and pipes and other items existing below the counter. Additionally, it is easy to view when the refill unit might need to be replaced, particularly in embodiments where a window or other means for viewing the contents of the refill unit are provided. For example, the container could simply be a transparent container and the majority of the container could be viewed, as in the embodiment of FIG. 3.

In light of the foregoing, it should be appreciated that the present invention significantly advances the art by providing a counter-mounted dispensing system that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A counter-mounted dispensing system comprising:
- a refill housing mounted above a counter;
- a refill unit separate and distinct from said refill housing so as to be selectively received in said refill housing as a unit in order to deliver a fluid within the refill unit to an end user, said refill unit including:
  - a container holding fluid to be dispensed,
  - and a pump communicating with the fluid in the container;
- a spout mounted above said counter;
- an actuation unit having pump actuator mechanisms, the actuation unit being mounted at a position below said counter; and
- a passage extending through the counter, wherein said pump and said pump actuator mechanisms operatively communicate through said passage upon installing said refill unit in said refill housing.

2. The dispensing system of claim 1, further comprising:
- a power source associated with said actuation unit to provide power to actuate said pump actuator mechanisms and cause said pump to dispense fluid.

3. The dispensing system of claim 2, wherein said power source is selected from batteries and a mains power supply.

4. The dispensing system of claim 1, wherein said pump is a liquid pump that advances liquid only, the dispensing system further comprising:
- an outlet nozzle; and
- an air pump separate and distinct from said liquid pump, said air pump advancing air to said outlet nozzle and said liquid pump advancing liquid to said outlet nozzle.

5. The dispensing system of claim 4, wherein said air and liquid mix at said mixing nozzle to create a foam.

6. The dispensing system of claim 1, wherein said housing includes a bolt member extending into said passage in said counter, said actuation unit engaging said bolt member.

7. The dispensing system of claim 6, wherein said actuation unit includes a gear-driven actuation rod extending into said bolt member.

8. The dispensing system of claim 7, wherein said pump is a reciprocating piston pump and said actuation rod reciprocates within said bolt member to actuate said reciprocating piston pump.

9. The dispensing system of claim 8, wherein said reciprocating piston pump advances both air and said fluid in said container.

10. The dispensing system of claim 1, wherein said actuation unit includes a bolt member extending into said passage in said counter.

* * * * *